US005564508A

United States Patent [19]

Renski

[11] Patent Number: 5,564,508

[45] Date of Patent: Oct. 15, 1996

[54] REPLACABLE WEAR RUNNER

[75] Inventor: William J. Renski, Peoria, Ill.

[73] Assignee: Caterpillar Inc., Peoria, Ill.

[21] Appl. No.: 510,894

[22] Filed: Aug. 3, 1995

[51] Int. Cl.[6] ..... E02F 9/28

[52] U.S. Cl. ..... 172/772; 37/456

[58] Field of Search ..... 172/772, 772.5, 172/753, 713; 37/451, 456, 455, 450

[56] References Cited

U.S. PATENT DOCUMENTS

| | | | |
|---|---|---|---|
| 1,937,243 | 11/1933 | Pearch | 172/772 X |
| 3,762,079 | 10/1973 | Lukavich et al. | 37/455 X |
| 3,919,792 | 11/1975 | Hahn et al. | 37/455 |
| 4,231,173 | 11/1980 | Davis | 172/762 X |
| 4,587,751 | 5/1986 | Sjogren | 172/753 X |
| 4,602,445 | 7/1986 | Nilsson | 172/752 X |
| 4,995,176 | 2/1991 | Briscoe et al. | 37/141 |
| 5,005,304 | 4/1991 | Briscoe et al. | 37/141 |
| 5,056,243 | 10/1991 | Sprunger et al. | 172/753 X |
| 5,088,214 | 2/1992 | Jones | 37/141 |
| 5,241,765 | 9/1993 | Jones et al. | 172/772 X |
| 5,350,022 | 9/1994 | Launder et al. | 172/772 X |

FOREIGN PATENT DOCUMENTS 0262856 3/1990 European Pat. Off. .

*Primary Examiner*—Terry Lee Melius
*Assistant Examiner*—Christopher Novosad
*Attorney, Agent, or Firm*—O. Gordon Pence

[57] ABSTRACT

Replaceable wear runners are disclosed for protecting a structure, such as a bucket, from abrasive materials. Such wear runners include a mounting base that is welded to the structure and a replaceable wear cover. Apparatus for releasably retaining the cover to the mounting base permits quick and easy mounting and removal of the wear cover without the use of special tools. The retaining apparatus includes an arcuate retainer that is slidably received into an arcuate slot accessible through the top of the cover.

7 Claims, 5 Drawing Sheets

REPLACABLE WEAR RUNNER

TECHNICAL FIELD

This invention relates generally to replaceable wear runners for installation on the wearable part of a structure to protect such structure from engagement with abrasive material and the like.

BACKGROUND ART

Loader, excavator, drag line buckets and shovels, truck and scraper beds, and similar structures of earth excavating and earth moving equipment are subject to wear from engagement with dirt, sand, rocks and other abrasive materials. It has been common practice to "tile" such structures with replaceable wear runners to protect the structure from wear due to contact with such abrasive materials. Examples of prior wear runners are depicted in U.S. Pat. Nos. 4,995,176 issued Feb. 26, 1991 and 5,005,304 issued Apr. 9, 1991 both to Terry L. Briscoe. Some type of mechanical lock is typically used to retain the replaceable cover of the wear runner onto the mounting base. One type of mechanical lock that may be used is disclosed in U. S. Pat. No. 5,088,214 issued Feb. 18, 1992 to Larren F. Jones. Such lock, however, uses a rubber latch member, which may tear, fatigue or otherwise deteriorate in use. Any such failure would permit the loss of the wear cover. It is also desirable for wear covers to be reversible and easily removable without the use of special tools to facilitate the ease of replacement, the moving around and/or reversal of the wear covers in the field as needed to obtain the greatest wear life from such covers.

The present invention is directed to providing an easily replaceable wear runner without the shortcomings of the prior attempts at securing the wear cover to the mounting base.

DISCLOSURE OF THE INVENTION

In accordance with one aspect of the present invention, there is provided replaceable wear runner for installation on a structure to protect such structure from engagement with abrasive material. Such wear runner includes a mounting base, a replaceable wear cover and apparatus for releasably retaining the cover onto the base. The mounting base is adapted to be secured to the structure and is disposed along a longitudinal axis and has opposite sides and at least two flanges. A respective one of the flanges extends transversely from one of the opposite sides of the base with each of the flanges having an undercut latch surface formed thereon. The replaceable wear cover is adapted to be received upon the mounting base and has an outer face and at least two inwardly extending feet. Each of the feet have a mating latch surface thereon positionable to engage the latch surface on a respective one of the flanges of the base upon movement of the cover in one longitudinal direction relative to the mounting base. The apparatus for releasably retaining the cover onto the base includes a generally arcuate retainer and a generally arcuately shaped slot. The slot is cooperatively formed between the cover and the base and defines a first engagement surface provided on the base, a second engagement surface provided on the cover, and an opening through the outer face of the cover to provide ingress and egress to the slot by the retainer. The first engagement surface is oriented normal to the longitudinal axis and faces in the one direction relative thereto. The second engagement surface is disposed in a spaced opposing relation to the first engagement surface of the base. The retainer has opposite sides with one side thereof being positionable to engage the first engagement surface and with its opposite side being positionable to engage the second engagement surface such that the cover is prevented from moving in a direction opposite to the one longitudinal direction when the retainer is disposed within the slot.

In accordance with another aspect of the present invention, there is provided a replaceable wear cover adapted for mounting onto a mounting base. The mounting base is secured to a structure subjected in use to abrasive materials. The wear cover includes a generally rectangular body portion disposed along a longitudinal axis. The body also has an inner face, a planar outer face, and a pair of opposite longitudinally extending side walls projecting toward the mounting base. The wear cover also includes two pairs of inwardly extending feet. One of each pair are adjacent a respective one of the longitudinal side walls. Each of the feet have an undercut latch surface oriented normal to the longitudinal axis and that face in one direction relative thereto. The wear cover has a partially formed arcuate slot. The slot has an arcuate inner periphery and a side formed in the inner face of the body portion. The inner periphery is generated by a radius located above the outer face and parallel to the longitudinal axis. The side defines an engagement surface facing in a direction opposite to the one longitudinal direction. The slot has an end thereof opening through the outer face to provide ingress and egress to the slot from the outer face side of the body portion.

BEST MODE FOR CARRYING OUT THE INVENTION

Figure 1:
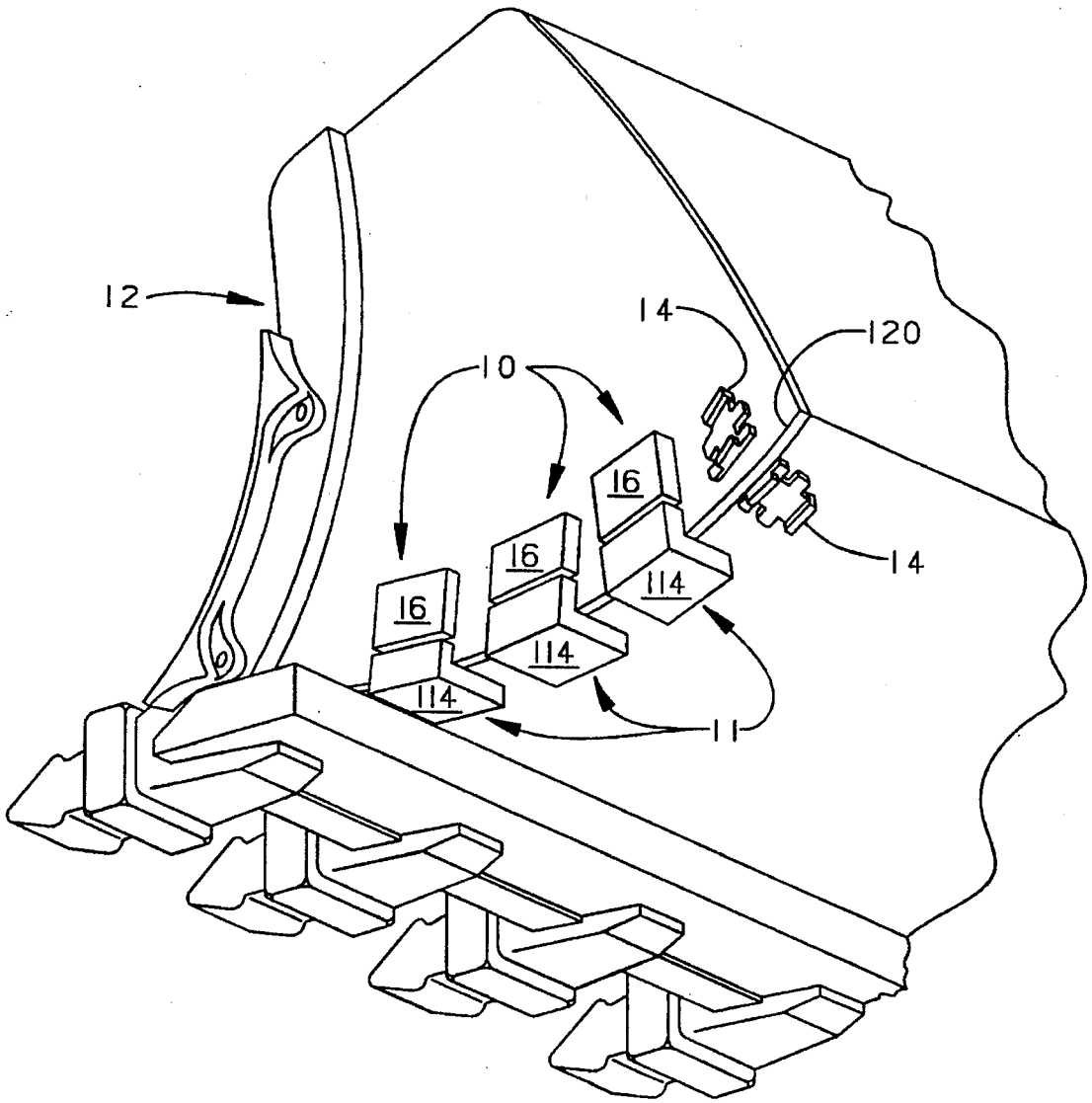
FIG. 1 is a fragmentary diagrammatic perspective representation of a bucket on which wear runners embodying the features of the present invention are employed.

Referring more particularly to the drawings, replaceable wear runners embodying the principles of the present invention are depicted at 10 and 11 in FIG. 1 and are adapted for installation on a structure to protect the structure from engagement with abrasive materials. One such structure is a large bucket 12 as illustrated in FIG. 1 for a loader, excavator front shovel or similar earthmoving machine or the like (not shown). However, wear runners 10 and 11 may be used on a number of earthworking structures requiring protection from abrasive materials, such as large truck beds, scraper bodies, bulldozer blades and the like and the present invention is not intended to be limited to use on buckets, but is intended to be applicable to any such structure where protection from abrasive materials is desired.

Figure 2:
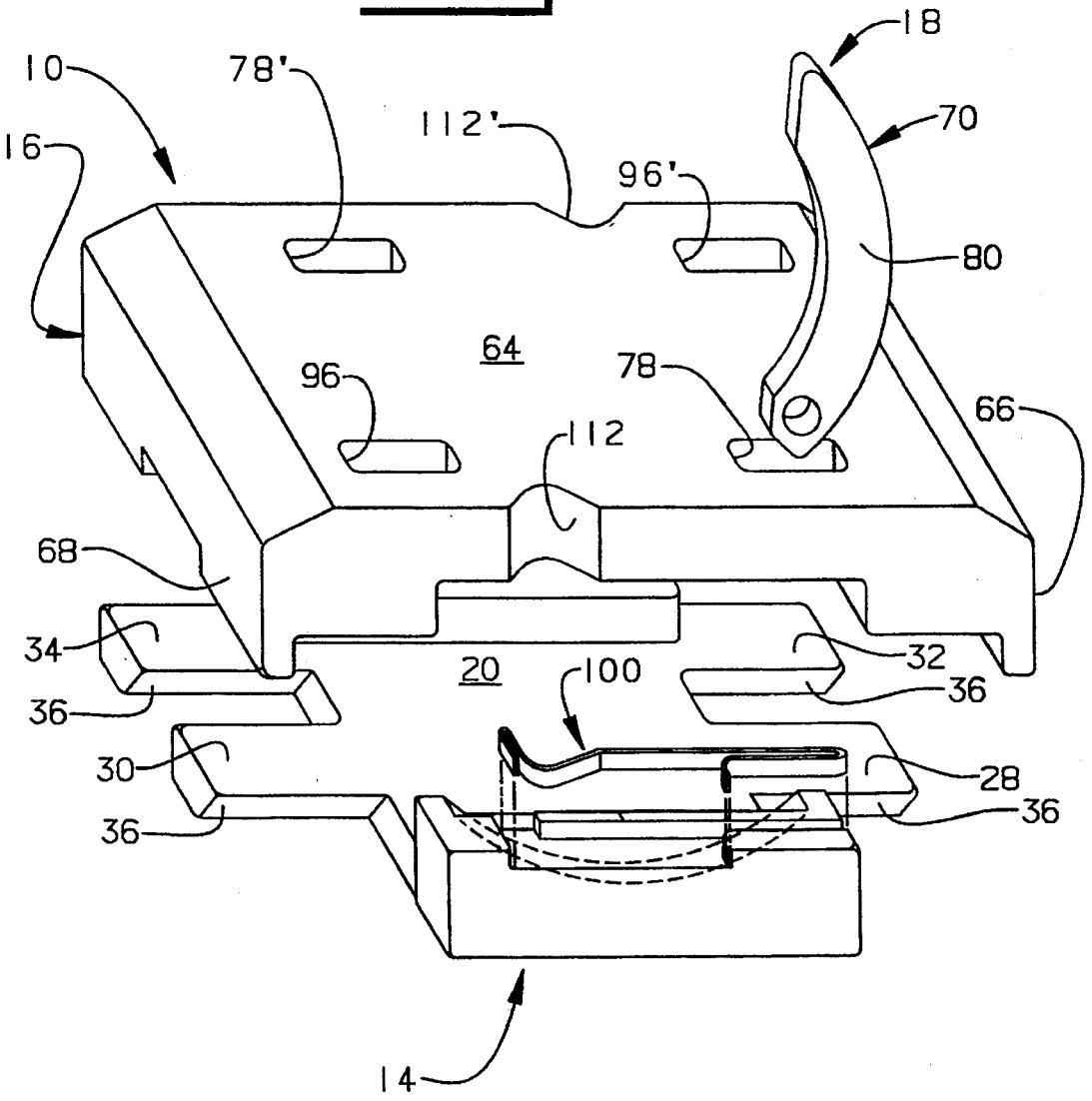
FIG. 2 is an exploded perspective view of one of the wear runners depicted in FIG. 1 and illustrating the principle components of such wear runner.

As more clearly seen in FIG. 2, replaceable wear runner 10 includes a mounting base 14, a replaceable wear cover 16 and apparatus 18 for releasable retaining the cover 16 onto the mounting base 14.

Figure 3:
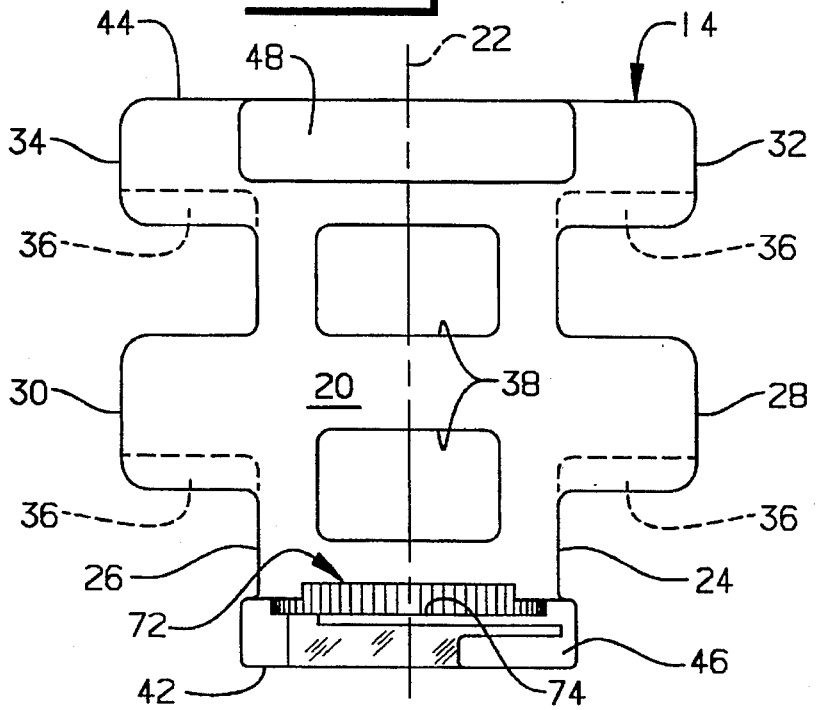
FIG. 3 is a plan view of the mounting base of the wear runner depicted in FIG. 2.

As shown in FIG. 3, the mounting base 14 has a plate-like body 20 disposed along a longitudinal axis 22 and having opposite sides 24,26 and at least two flanges 28,30. A respective one of the flanges extend transversely from one of the opposite sides of the base. Preferably, the mounting base is provided with a pair of flanges (the two additional rearward flanges being numbered 32,34 on each of the opposite sides). Each of the flanges 28,30 and 32,34 are provided with an undercut latch surface 36 for purposes to be hereinafter described. The mounting base 14 may be secured to the structure 12 by means of welding. To this end, one or more weld holes, such as those shown at 38, may be provided in the body 20, as well as beveled edges, shown at 40 in FIG. 6, for use as weld edges for welding purposes.

The body 20 also includes a first end 42 and second end 44 (FIG. 3). A pair of transversely extending upright flanges 46 and 48 are also provided on the body portion 20, with the flange 46 being adjacent the first end 42 and the upright flange 48 being adjacent the second end 44.

Figure 6:
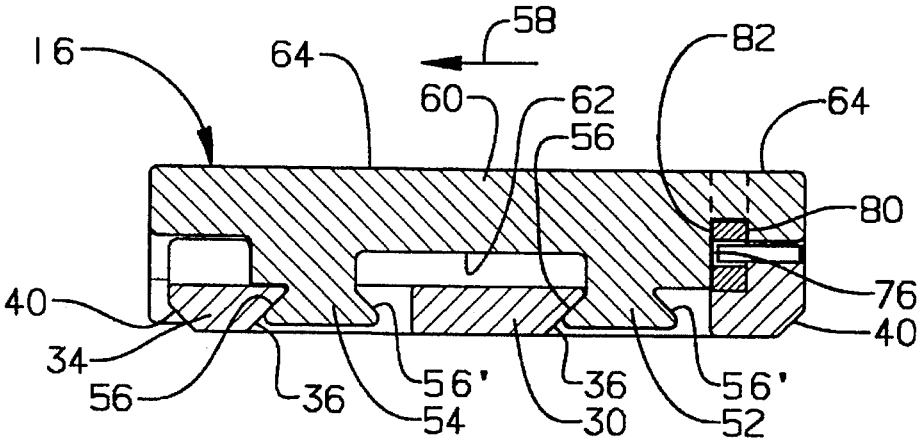
FIG. 6 is a cross-sectional view taken generally along line 6—6 of FIG. 4 to illustrate the preferred arrangement for mounting the wear cover to the mounting base.
Figure 7:
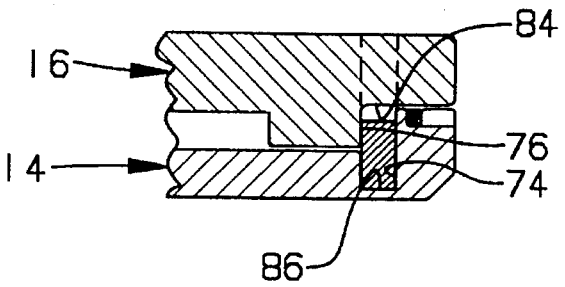
FIG. 7 is a cross-sectional view taken generally along line 7—7 of FIG. 4 to better show the retaining apparatus of the present invention.
Figure 8:
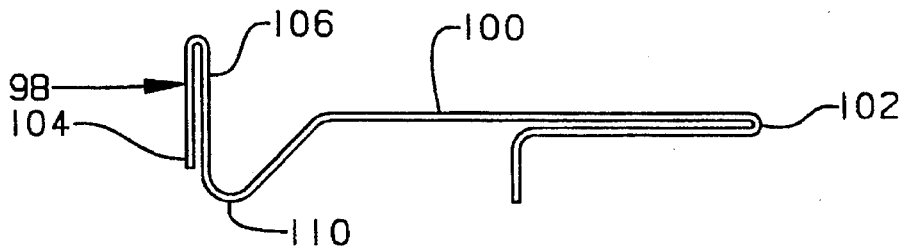
FIG. 8 is an enlarged plan view of the spring catch employed by the retaining apparatus.
Figure 9:
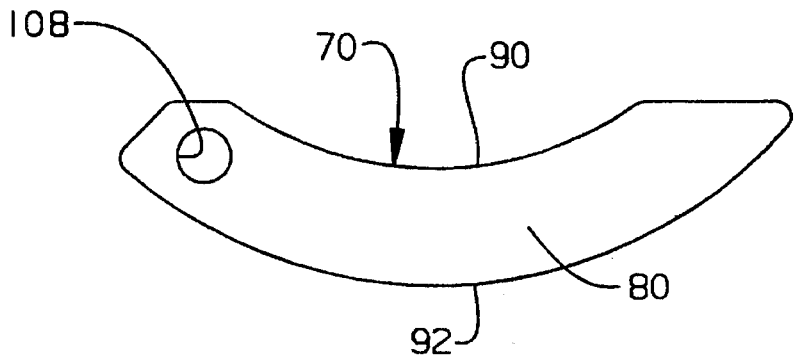
FIG. 9 is an enlarged front view of the retainer of the retaining apparatus.

Referring more particularly to FIG. 6, the wear cover 16 includes at least two inwardly extending feet on opposite sides thereof, one of which is shown at 52, to mate with the side flanges 28,30 on the base 14. However, the wear cover 16 is preferably provided with a pair of feet on each side thereof, one of the second pair of feet being shown at 54. Each of the feet 52,54 are provided with a mating latch surface 56 thereon which are positionable to engage the latch surfaces 36 on a respective one of the flanges 28,30, 32,34 of the base 14 upon movement of the cover 16 in one longitudinal direction, indicated by arrow 58, relative to the mounting base.

Figure 4:
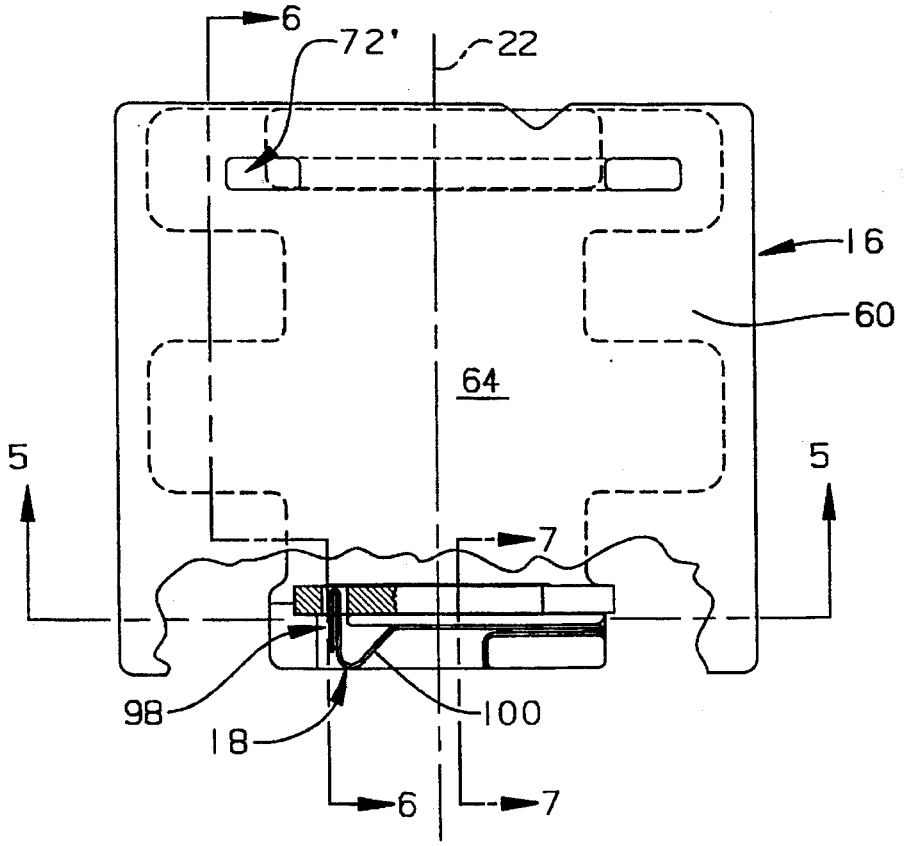
FIG. 4 is a plan view of the wear cover of the wear runner depicted in FIG. 2, with a portion broken away to show the retaining apparatus of the present invention.
Figure 5:
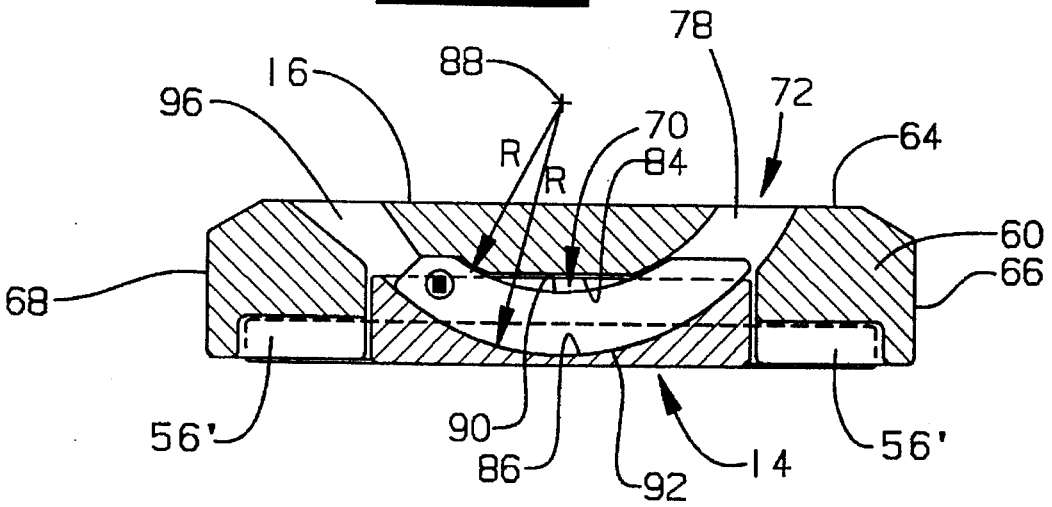
FIG. 5 is a cross-sectional view taken generally along line 5—5 of FIG. 4 to illustrate the retaining apparatus.

As shown in FIGS. 4 and 6, the wear cover 16 has a generally rectangular body portion 60 disposed along the longitudinal axis as indicated at 22 and has an inner face 62, a planar outer face 64 and a pair of opposite longitudinally extending sidewalls 66,68 (FIG. 5) projecting from the inner face 62 of the body portion 60 toward the mounting base 14. Each of the pair of inwardly extending feet 52,54 are disposed adjacent of respective one of the longitudinal sidewalls 66,68. The undercut latch surfaces 56 on each of the feet 52,54 are oriented normal to the longitudinal axis 22 and face in the direction of the arrow 58 shown in FIG. 6.

The retaining apparatus 18 includes a generally arcuate retainer 70 and a generally arcuately shaped slot 72. The slot 72 is cooperatively formed between the cover 16 and the mounting base 14 and defines a first engagement surface 74 which is provided on the mounting base 14 and a second engagement surface 76 which is provided on the wear cover 16. A first opening 78 is provided through the outer face 64 of the cover 16 to provide ingress and egress to the slot 72 by the retainer 70. The first engagement surface 74 in the base 14 is oriented normal to the longitudinal axis 22 and faces in one longitudinal direction relative thereto, that direction being in the direction of the arrow 58 shown in FIG. 6. The second engagement surface 76 in the cover 16 is disposed in a predetermined spaced opposing relation to the first engagement surface 74. The arcuate retainer 70 has opposite sides 80,82 with the first side 80 being positionable to engage the first engagement surface 74 and with the second side 82 being positionable to engage the second engagement surface 76 such that the cover 16 is prevented from moving in a direction opposite to the longitudinal direction of arrow 58 when the retainer 70 is disposed within the arcuate slot 72.

In particular, the cooperatively formed slot 72 includes an inner periphery 84 and an outer periphery 86. At least a portion of each of the peripheries 84, 86 may each be generated by a radius, the centers 88 of which coincide when the cover 16 is mounted upon the base 14. The coincident centers are preferably located above and parallel to the longitudinal axis 22 of the base. The retainer 70 has an inner periphery 90 and an outer periphery 92 which are generated by radii having a common center and which are sized to permit free passage of the retainer into the slot 72.

The cover 16 is also preferably provided with a second opening 96 which is located in registry with the end of the slot 72 which is opposite the end of the slot in registry with the first opening 78. The second opening 96 is adapted to permit access to the retainer 70 for removal purposes. In such regard, a common tool such as a flat bar or screw driver (not shown) may be inserted through the second opening to engage the adjacent end of the retainer 70. By applying a force to such tool, the retainer 70 can be forced out of the slot 72 through the first opening 78.

In addition, the wear cover 16 is also made symmetrical end for end in order to enable the cover to be reversible. In this regard, the cover 14 is provided with another first opening 78', another second opening 96' and another relief 112', as shown in FIG. 2, opposing mating latch surfaces 56', as shown in FIG. 6, and the features of the slot 72, such as a corresponding second engagement surface similar to 76 and an inner periphery similar to 84 (both of which are not shown).

The retaining apparatus 18 also includes a spring catch 98 adapted to engage the retainer 70 to releasable maintain the retainer in place. In particular, the spring catch 98 includes a leaf spring 100 having a first end portion 102 held by the mounting base 14 in a suitable groove and a second end portion 104 which is provided with a transversely extending leg 106. The leg 106 is adapted to be received within an aperture 108 provided in the retainer 70.

The second end portion 104 of the leaf spring 100 is preferably provided with a loop portion 110 while the wear cover 16 is provided with a relief 112. Relief 112 is disposed in registry with the loop portion so as to provide access to the loop portion 110 with a screw driver or similar tool (not shown), such tool can be used to apply a force to the leaf spring in order to release the leg 106 of the leaf spring 100 from the aperture 108 in the retainer 70 so that the retainer 70 can be removed from slot 72.

Figure 10:
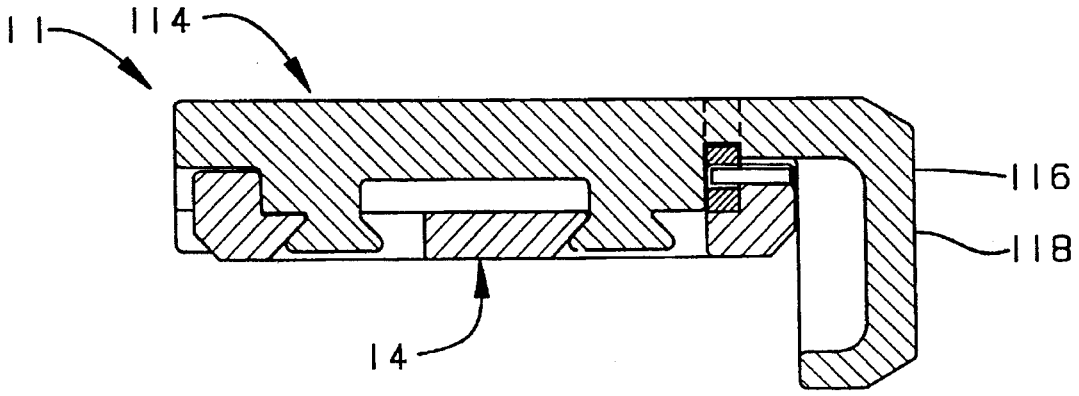
FIG. 10 is a cross-sectional view similar to FIG. 6, but illustrating the corner wear runner depicted in FIG. 1.

The wear runner 11, shown in FIGS. 1 and 10 differs from wear runner 10 only in its use of a corner wear cover 114. Cover 114 includes an end extension 116 having a corner leg 118 of sufficient length to extend around and protect a corner edge 120 of the bucket. Wear runner 11 uses the same mounting base 14 and retaining apparatus 18 as wear runner 10.

INDUSTRIAL APPLICABILITY

The replaceable wear runners 10 are adapted to protect the wearable portions of a structure, such as bucket 12, from engagement with abrasive material. With a plurality of mounting bases 14 welded at suitable locations on the bucket 12, the replaceable wear covers 16 are quickly and easily attached to a respective mounting of the bases 14. Attachment is effected by placing the wear cover 16 over the mounting base 14 with the feet 52,54 slightly forward of the transversely extending flanges 28,30,32 and 34. Then the cover 16 may be slid in the direction of arrow 58 to seat the mating latch surfaces 56 on the feet 52,54 with the latch surfaces 36 on the flanges 28,30,32 and 34. Once this is accomplished, the arcuate retainer 70 may be inserted into the arcuate slot 72 to a position where the leg 106 of the leaf spring 100 may be engaged into the aperture 108 of the retainer. With the retainer 70 in place and secured by the leaf spring, the cover cannot be dislodged from the mounting base, even when substantial forces or large impact loads are exerted on the cover. However, when desired, the cover can be easily and quickly removed with the use of readily available hand tools, such as a screw driver, and with very little effort. To remove the cover, the leg 106 of the leaf spring 100 is easily pried from the aperture 108 and the retainer 70 is pushed out of the slot 72. Once the retainer 70 is removed, the cover 16 may be slid forward slightly and lifted off mounting base 14. The removed cover 16 may be simply turned end for end and remounted, replaced with a new one or switched with a cover from another location. This allows one to even out non-uniform wear patterns on the covers and to maximize their useful wear lives.

The corner wear cover 11 is mounted and removed in the same manner as wear cover 10.

Other aspects, objects and advantages of the present invention can be obtained for a study of the drawings, the disclosure and the appended claims.

I claim:

1. A replaceable wear runner for installation on a structure to protect such structure from engagement with abrasive material comprising:

a mounting base adapted to be secured to said structure, said base being disposed along a longitudinal axis and having opposite sides and a flange, said flange having an undercut latch surface formed thereon;

a replaceable wear cover adapted to be received upon said mounting base and having an outer face and an inwardly extending foot, said foot having a mating latch surface thereon positionable to engage the latch surface on said flange of said base upon movement of said cover in one longitudinal direction relative to said mounting base; and apparatus for releasably retaining said cover onto said base, said retaining apparatus including a generally arcuate retainer and a generally arcuately shaped slot, said slot being cooperatively formed between said cover and said base and defining a first engagement surface provided on said base, a second engagement surface provided on said cover, and an opening through the outer face of said cover to provide ingress and egress to said slot by said retainer, said first engagement surface being oriented normal to said longitudinal axis and facing in said one direction relative thereto, and said second engagement surface being disposed in a spaced opposing relation to said first engagement surface of said base, and said retainer having opposite sides with one side thereof being positionable to engage said first engagement surface and with its opposite side being positionable to engage the second engagement surface such that said cover is prevented from moving in a direction opposite to said one longitudinal direction when the retainer is disposed within said slot, said slot including an inner periphery and an outer periphery, each periphery being generated by radii having a common center located above and parallel to the longitudinal axis of said base, and said retainer having an inner periphery and an outer periphery generated by radii having a common center and sized to permit free passage of said retainer into said slot.

2. The wear runner of claim 1 wherein said retaining apparatus includes:

a spring catch adapted to engage said retainer to releasably maintain said retainer in place.

3. The wear runner of claim 2 wherein said retainer has an aperture and said spring catch includes a leaf spring, said leaf spring having a first end portion held by said mounting base and a second end portion with a transversely extending leg adapted to be received within said aperture of said retainer.

4. The wear runner of claim 3 wherein said second end portion of said leaf spring is provided with a loop portion and said wear cover is provided with a relief in registry with said loop portion so as to provide access thereto in order to release the leg of said leaf spring from the aperture in said retainer.

5. The wear runner of claim 4 wherein said mounting base has opposite sides and includes a pair of flanges on each of said opposite sides, each flange having an undercut latch surface thereon, and said wear cover has a mating latch surface for each of said latch surfaces on said flanges.

6. The wear runner of claim 5 wherein said slot has opposite ends and said opening through the outer face of said cover is located at one of said ends and said cover has a second opening located at the other end of said slot, said second opening being adapted to permit access to said retainer for removal purposes.

7. A replaceable wear cover adapted for mounting onto a mounting base, said mounting base being secured to a structure subjected in use to abrasive materials, comprising:

a generally rectangular body portion disposed along a longitudinal axis and having an inner face, a planar outer face, a pair of opposite longitudinally extending side walls projecting toward said mounting base;

two pairs of inwardly extending feet, one of each pair being adjacent a respective one of the longitudinal side walls, each of said feet having a latch surface oriented normal to said longitudinal axis and facing in one direction relative thereto; and a partially formed arcuate slot for receiving an arcuate retainer, said slot having an arcuate inner periphery and a side formed in the inner face of said body portion, said inner periphery being generated by a radius having a center located above the outer face and parallel to the longitudinal axis and said side defining an engagement surface facing in a direction opposing said one direction, said slot having an end thereof opening through said outer face to provide ingress and egress to said slot through the outer face of said body portion and said slot being adapted to receive said arcuate retainer by the circular movement of said retainer through said opening generally about said center of the radius of said inner periphery.

* * * * *